US009494965B2

(12) United States Patent
Min

(10) Patent No.: US 9,494,965 B2
(45) Date of Patent: Nov. 15, 2016

(54) ORGAN TYPE ACCELERATOR PEDAL APPARATUS

(71) Applicants: Hyundai Motor Company, Seoul (KR); Kia Motors Corp., Seoul (KR)

(72) Inventor: Jeong Seon Min, Whasung-Si (KR)

(73) Assignees: Hyundai Motor Company, Seoul (KR); Kia Motors Corp., Seoul (KR)

( * ) Notice: Subject to any disclaimer, the term of this patent is extended or adjusted under 35 U.S.C. 154(b) by 136 days.

(21) Appl. No.: 14/097,135

(22) Filed: Dec. 4, 2013

(65) Prior Publication Data

US 2015/0027264 A1 Jan. 29, 2015

(30) Foreign Application Priority Data

Jul. 25, 2013 (KR) ..... 10-2013-0087744

(51) Int. Cl.
*G05G 1/44* (2008.04)
*G05G 25/04* (2006.01)

(52) U.S. Cl.
CPC ..... *G05G 1/44* (2013.01); *G05G 25/04* (2013.01); *Y10T 74/20534* (2015.01)

(58) Field of Classification Search
CPC .. Y10T 74/20534; B60K 26/02; G05G 1/36; G05G 1/44
USPC ..... 74/512, 513
See application file for complete search history.

(56) References Cited

U.S. PATENT DOCUMENTS 1,428,082 A * 9/1922 Gammon ..... B60K 26/02 74/513
1,700,643 A * 1/1929 Nordell ..... 74/513
1,821,589 A * 9/1931 Thorp ..... G05G 1/30 74/513
3,111,861 A * 11/1963 Young ..... G05G 1/483 16/257
3,926,275 A 12/1975 Nersesian
2008/0314192 A1* 12/2008 Willemsen et al. ..... 74/512
2009/0151502 A1* 6/2009 Kim et al. ..... 74/513
2010/0132503 A1* 6/2010 Hong ..... G05G 1/30 74/560
2010/0319480 A1* 12/2010 Nebuya ..... G05G 1/36 74/513
2015/0027265 A1* 1/2015 Min ..... G05G 1/44 74/513
2015/0059515 A1* 3/2015 Min ..... G05G 1/44 74/512

FOREIGN PATENT DOCUMENTS

JP 2003-25863 A 1/2003
JP 2003-312304 A 11/2003
KR 10-2006-0036222 A 4/2006
KR 1020090064209 A 6/2009
KR 10-2010-0046653 5/2010

OTHER PUBLICATIONS

Spherical / Define Spherical at Dictionary.com, Jul. 21, 2015.*
Sphere / Define Sphere at Dictionary.com, Jul. 21, 2015.*
Merriam-webster.com/dictionary/arcuate; Oct. 30, 2015.*
Images of define circular, Google Search, Mar. 7, 2016.*
Define circular, Google Search, Feb. 24, 2016.*

* cited by examiner

*Primary Examiner* — Vinh Luong
(74) *Attorney, Agent, or Firm* — Morgan, Lewis & Bockius LLP

(57) ABSTRACT

An organ type accelerator pedal apparatus may include a pedal housing having a lower mount fixed to a panel of a vehicle body located below a driver seat and an upper mount to which a pedal arm pivotally mounted, a pad pivotally mounted with respect to the pedal housing such that the pad is connected to the pedal arm via a carrier, and an articulated hinge fixedly coupled, at both ends thereof, between the pedal housing and the pad such that the articulated hinge is covered by the pedal housing and the pad so that the articulated hinge is not exposed to the outside.

5 Claims, 5 Drawing Sheets

ORGAN TYPE ACCELERATOR PEDAL APPARATUS

CROSS REFERENCE TO RELATED APPLICATION

The present application claims priority to Korean Patent Application No. 10-2013-0087744, filed on Jul. 25, 2013, the entire contents of which is incorporated herein for all purposes by this reference.

BACKGROUND OF THE INVENTION

1. Field of the Invention

The present invention relates, in general, to an organ type accelerator pedal apparatus and, more particularly, to an organ type accelerator pedal apparatus which can greatly reduce the effort required by a driver to depress the pedal.

2. Description of Related Art

Generally, an accelerator pedal apparatus in a vehicle is divided into a pendant type accelerator pedal which is mounted suspended from a dashboard and an organ type accelerator pedal which is mounted to a floor panel, according to a mounting structure.

In the case of an organ type accelerator pedal, a motion of a pad is the same as a motion of a driver's ankle, so that a driver can advantageously manipulate the organ type accelerator pedal more conveniently than a pendant type accelerator pedal.

As shown in FIGS. 1 and 2, an exemplary organ type accelerator pedal apparatus includes a pedal housing 1 which is fixedly mounted to a panel of a vehicle body (a floor panel) located below a driver seat, a pad 3, one end of which is connected to a pad-coupling part 1*a* of the pedal housing 1 via a hinge 2, so as to pivot via manipulation by a driver's foot, a pedal arm 5 which is disposed and mounted in an internal space 1*b* of the pedal housing 1 such that the pedal arm can pivot on a pivot axis 4 relative to the pedal housing 1, a carrier 6 which connects the pad 3 and one end of the pedal arm 5, and an elastic member 7 which is mounted to be supported, at both ends thereof, to the other end of the pedal arm 5 and an inner surface of the pedal housing 1, so as to provide an elastic restoring force to the pivot motion of the pedal arm 5.

However, in such an organ type accelerator pedal apparatus, since the pivot axis of the pad 3 is the hinge 2 fixed to the lower portion of the pad, there is a great difference in the effort to depress a pedal between when a driver presses an upper portion M1 of the pad, which is away from the hinge 2, and when a driver presses a lower portion M2 of the pad, which is close to the hinge 2, thus increasing driver fatigue.

That is, the effort required to depress the pedal is higher when pressing the lower portion M2 of the pad 3 than when pressing the upper portion M1 of the pad.

The foregoing is intended merely to aid in the understanding of the background of the present invention, and is not intended to mean that the present invention falls within the purview of the related art that is already known to those skilled in the art.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an organ type accelerator pedal apparatus which can reduce a difference in the effort required to depress a pedal when a driver steps on an upper portion of a pad and when a driver steps on a lower portion of the pad, thereby improving the convenience in manipulation, and reducing driver fatigue.

According to one aspect of the present invention, there is provided an organ type accelerator pedal apparatus including a pedal housing having a lower mount fixed to a panel of a vehicle body located below a driver seat and an upper mount to which a pedal arm is pivotally mounted, a pad pivotally mounted with respect to the pedal housing such that the pad is connected to the pedal arm via a carrier, and an articulated hinge fixedly coupled, at both ends thereof, between the pedal housing and the pad such that the articulated hinge is covered by the pedal housing and the pad so that the articulated hinge is not exposed to the outside.

A lower end of the pad may be mounted close to the lower mount, and the lower mount may be integrally provided with a cover part protruding so as to cover the lower end of the pad to prevent foreign substances and a driver's shoes from being caught in a gap between the lower mount and the lower end of the pad.

An end of the articulated hinge may be coupled to the pad to prevent an excessive deformation of the articulated hinge when the pad is pivoted towards the pedal housing, such that the end of the articulated hinge is positioned between the lower end of the pad and the carrier.

The articulated hinge may be configured such that, when the pad is pivoted towards the pedal housing, the articulated hinge comes into contact with a circular section at the lower end of the pad to prevent both an excessive deformation of the articulated hinge and lifting of the pad.

An inner surface of the cover part and an outer surface at the lower end of the pad may be formed into a pair of mating spherical surfaces for a smooth pivot motion of the pad.

A middle portion of the articulated hinge may be formed into a curved section protruding towards the lower mount.

The middle portion of the articulated hinge may be elastically bendable when the pad is pivoted.

The articulated hinge may have more elasticity than the pad.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
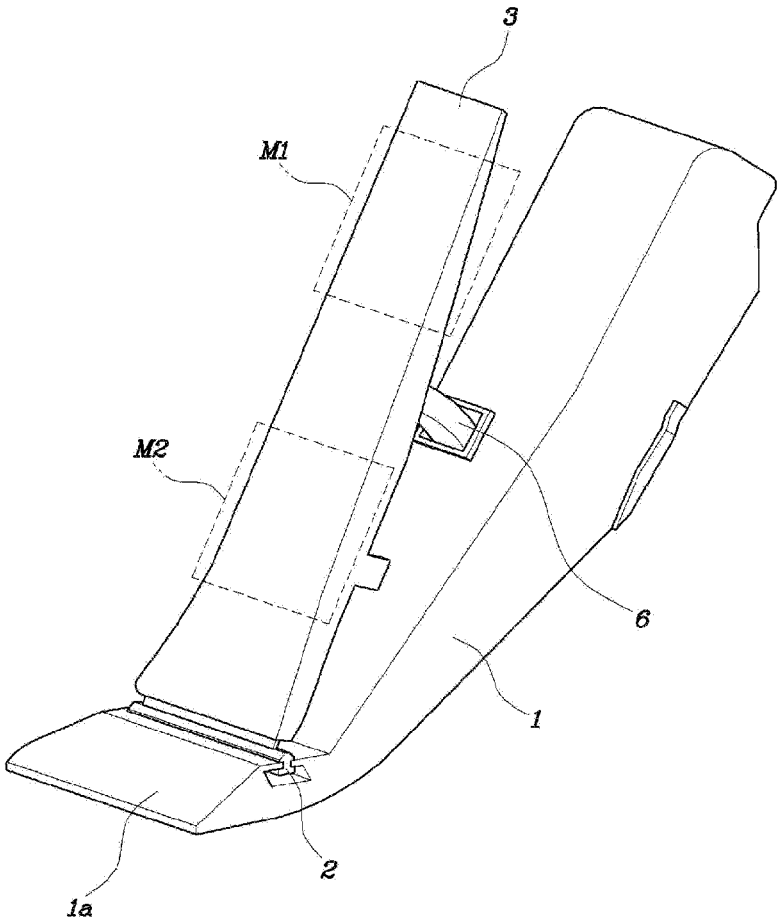
FIG. 1 (Related Art)
FIGS. 1 and 2 are views showing an organ type accelerator pedal apparatus according to the related art.
Figure 2:
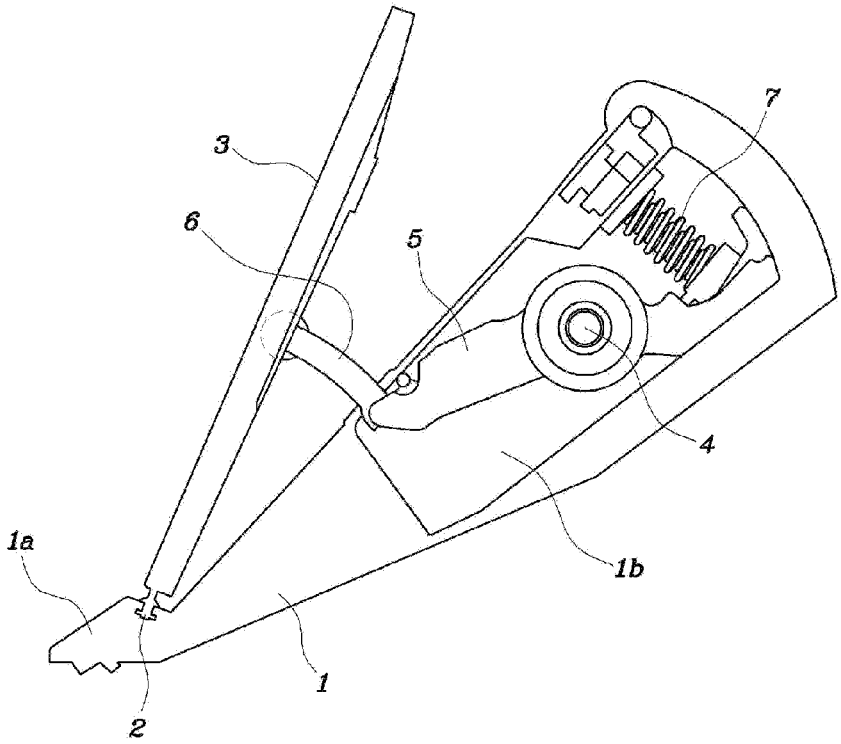
FIG. 2 (Related Art)

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinbelow, a description is made in detail of a preferred embodiment of an organ type accelerator pedal apparatus with reference to the accompanying drawings.

Figure 3A:
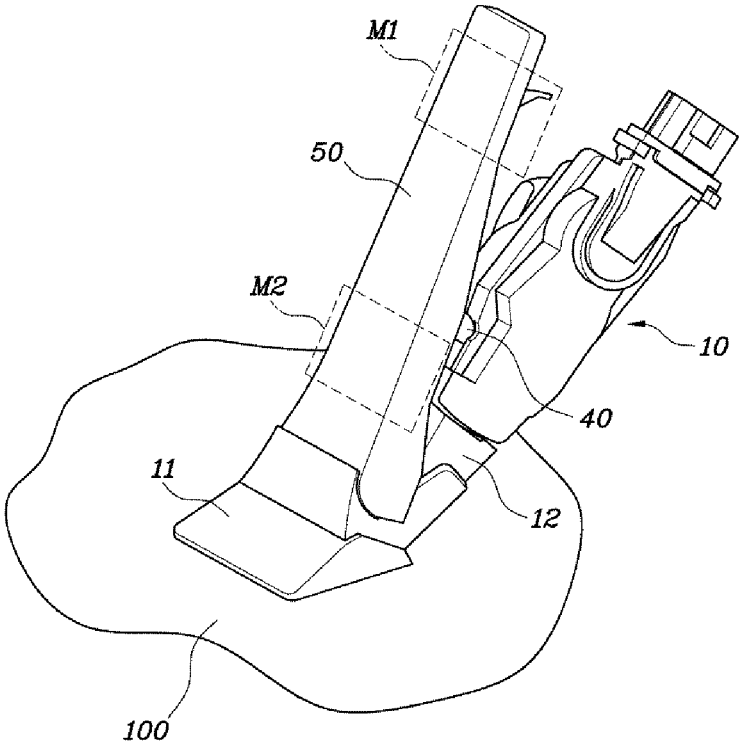
FIGS. 3A, and 3B and 4 are views showing an organ type accelerator pedal apparatus having an articulated hinge according to an exemplary embodiment of the present invention.
Figure 3B:
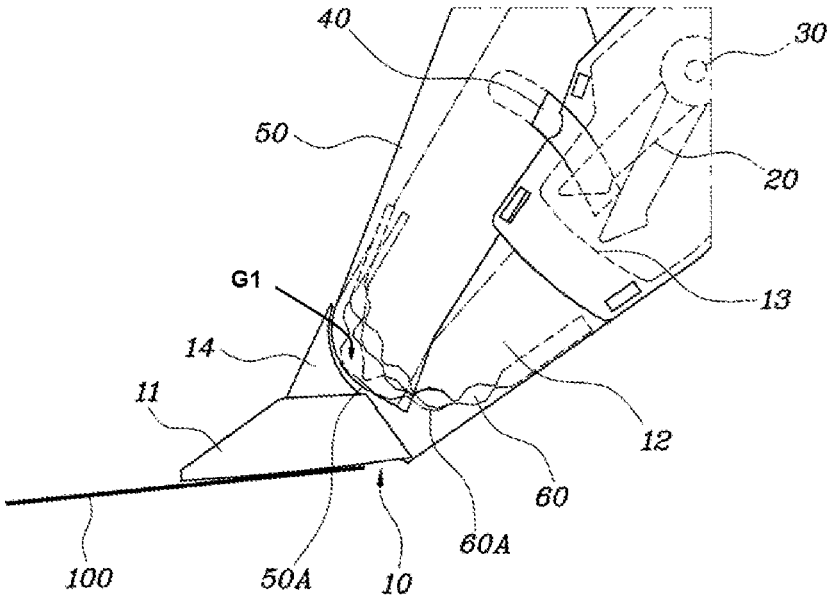
Figure 4:
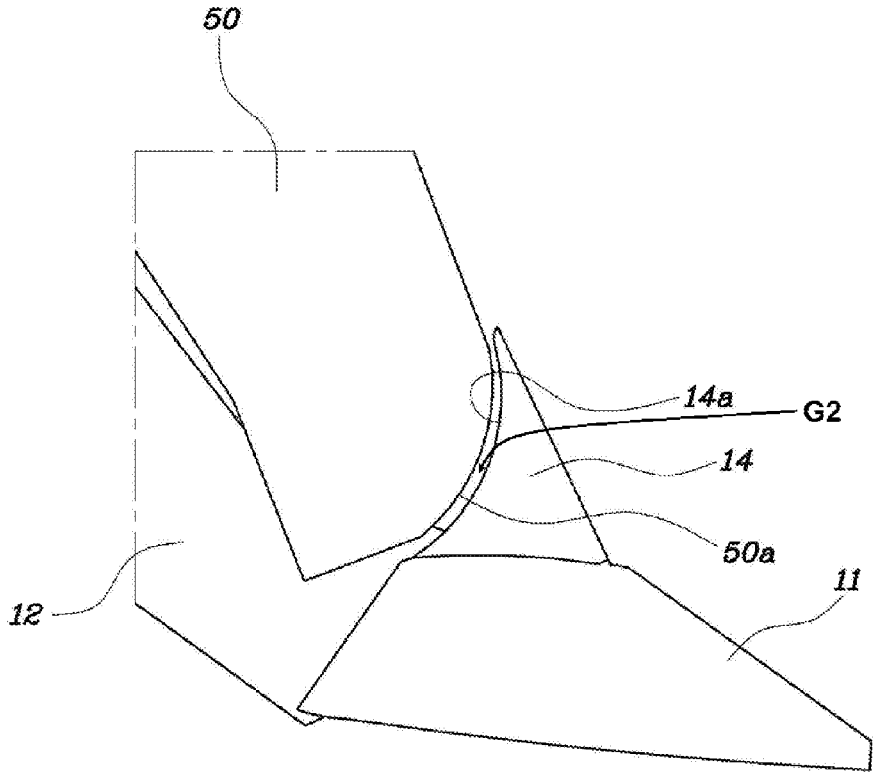
Figure 5:
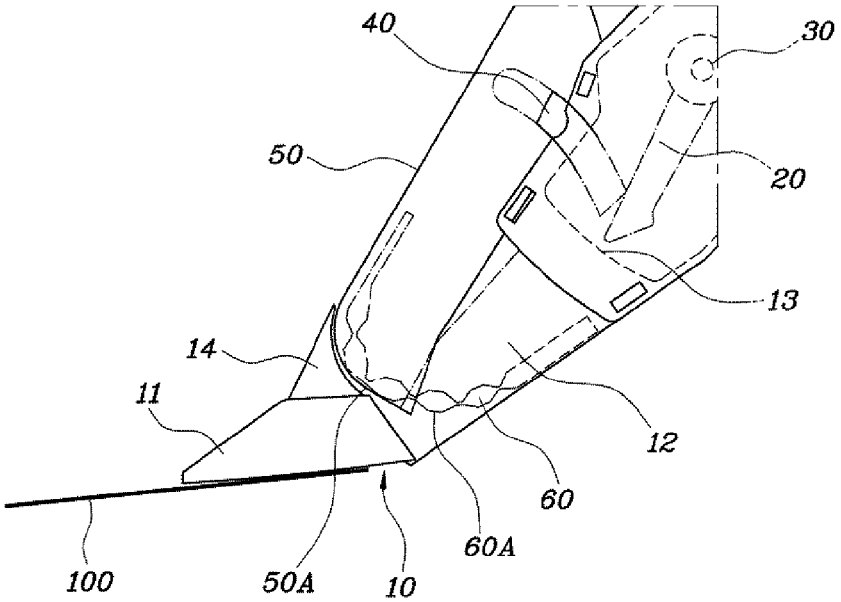
FIGS. 5 and 6 are views showing a pivotal motion of the pad 50 according to an exemplary embodiment of the present invention.
Figure 6:
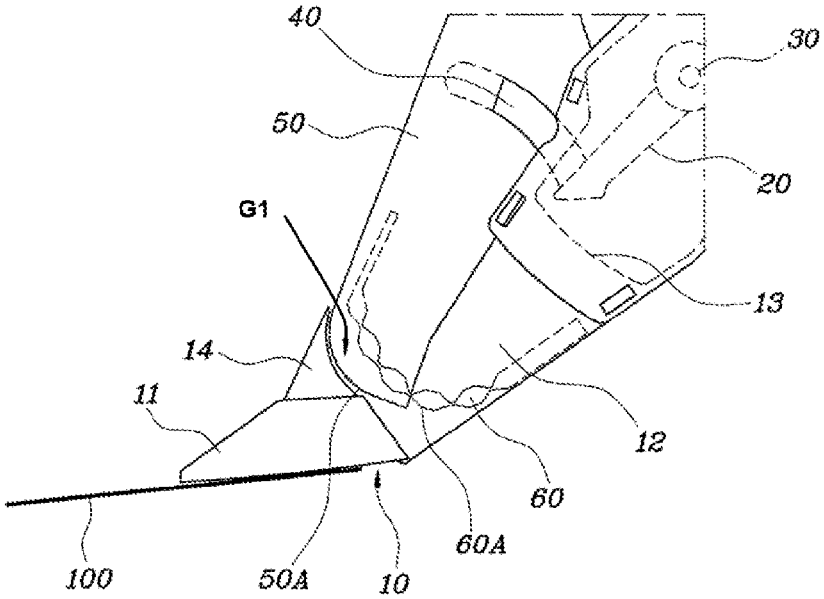

As shown in FIGS. 3A, 3B, and 4, the organ type accelerator pedal apparatus includes: a pedal housing 10 which has a lower mount 11 which is fixed to a panel 100 (a floor panel) of a vehicle body located below a driver seat and an upper mount 12 to which a pedal arm 20 is pivotally mounted via a pivot axis 30, a pad 50 which is pivotally mounted with respect to the pedal housing 10 such that the pad 50 is connected to the pedal arm 20 via a carrier 40, and an articulated hinge 60 which is fixedly coupled, at both ends thereof, between the pedal housing 10 and the pad 50 such that a middle portion 60A thereof is covered by the pedal housing 10 and the pad 50 so that the middle portion 60A is not exposed to the outside, wherein the middle portion 60A is formed into a curved section protruding towards the lower mount 11, and is elastically bendable when the pad 50 is pivoted.

Here, the upper mount 12 has an empty internal space 13 in which the pedal arm 20 is pivotally mounted.

A lower end of the pad 50 is mounted close to the lower mount 11, and the lower mount 11 is integrally provided with a cover part 14 which protrudes so as to cover the lower end of the pad 50 to prevent foreign substances and a driver's shoes from being caught in a second gap G2 between the lower mount 11 and the lower end of the pad 50 as shown in FIG. 4.

That is, the cover part 14 covers the lower end of the pad 50 so as to eliminate the second gap G2 between the lower mount 11 and the lower end of the pad 50, thereby preventing catching of foreign substances and a driver's shoes, such as high heels, which hinder a pivotal motion of the pad 50.

The cover part 14 and the pad 50 are arranged such that an inner surface 14*a* of the cover part 14 and an outer surface 50*a* at the lower end of the pad 50 come into contact with each other when the pad is pivoted. Here, in order to induce a smooth pivotal motion of the pad 50, the inner surface 14*a* and the outer surface 50*a* are preferably formed into a pair of mating curved surfaces.

That is, the inner surface 14*a* of the cover part 14 is formed into a concave spherical surface, and the outer surface 50*a* at the lower end of the pad 50 is formed into a convex spherical surface to mate with the concave spherical surface to have a first gap G1 with the articulated hinge 60 as shown in FIG. 3B.

The cover part 14 serves to come into contact with the lower end of the pad 50 when pivoted towards the pedal housing 10, so as to prevent an excessive pivotal motion of the pad 50 and an excessive deformation of the articulated hinge 60, thereby improving durability of the pedal apparatus.

One end of the articulated hinge 60 is coupled to the upper mount 12 close to the lower mount 11 via a coupling member, such as a bolt or screw, or a one-touch assembly structure, and the other end of the articulated hinge 60 is coupled to the lower end of the pad 50 via a coupling member, such as a bolt or screw, or a one-touch assembly structure.

One end of the articulated hinge 60, which is coupled to the pad 50 in order to prevent an excessive deformation of the articulated hinge 60 when the pad 50 is pivoted towards the pedal housing 10, is preferably mounted at a middle position between the lower end of the pad 50 and the carrier 40.

Further, the articulated hinge 60 is configured such that, when the pad 50 is pivoted towards the pedal housing 10, the articulated hinge 60 in which a middle portion thereof is made of an arcuate shape, comes into contact with an inner surface of the circular section 50A at the lower end of the pad 50 to prevent both an excessive deformation of the articulated hinge 60 and a lift of the pad 50.

The articulated hinge 60 is characteristically formed of a material, preferably including, but not limited to, thermoplastic elastomer (TPE) that is more elastic than the pad 50 to minimize the effort required to depress the pedal.

The operation of the pedal apparatus of the present invention will now be described.

When a driver steps on the upper portion M1 of the pad 50 relative to the carrier 40 according to driver's build, driving habit, or the like, the driver can pivot the pad 50 with ease so that the effort required to depress the pedal and therefore fatigue of a driver's ankle can be minimized.

Further, when the driver steps on the lower portion M2 of the pad 50 relative to the carrier 40, the articulated hinge 60 is tilted while being elastically bent, so that, as compared to the conventional fixed-type hinge 2, with the elastic motion of the articulated hinge 60, the effort required to depress the pedal and therefore fatigue of a driver's ankle can be considerably reduced.

Thus, according to the organ type accelerator pedal apparatus, there is merely a slight difference in effort required to depress a pedal when a driver respectively steps on the upper and lower portions M1 and M2 of the pad 50, thereby improving the convenience in manipulation of the pad 50, and furthermore greatly reducing driver fatigue caused from the manipulation of the pad.

Further, the present invention provides the cover part 14 which covers a gap between the lower end of the pad 50 and the lower mount 11, thereby preventing foreign substances and a driver's shoes, such as high heels, from being caught in the gap, ensuring a more stable operation of the pad 50.

Further, the present invention provides the structure that the articulated hinge 60 restricts an excessive motion of the lower end of the pad 50, thereby preventing an excessive lifting of the pad 50 from the pedal housing 10, and therefore an injury to a driver's ankle caused from the lifting of the pad 50.

Further, the inner surface 14*a* of the cover part 14 and the outer surface 50*a* at the lower end of the pad 50 are formed into a pair of mating spherical surfaces for a smooth pivot motion of the pad 50, thereby ensuring a more stable operation of the pad 50.

Furthermore, the inner surface 14*a* of the cover part 14 serves to come into contact with the outer surface 50 at the lower end of the pad 50 when pivoted towards the pedal housing 10, so that an excessive pivotal motion of the pad 50 is prevented when the driver steps on the pad 50, thereby contributing to an improvement in durability of the articulated hinge 60 and particularly in sensitivity of pedal effort.

According to an exemplary embodiment of the present invention, the organ type accelerator pedal apparatus reduces a difference in the effort required to depress a pedal when a driver respectively steps on the upper and lower portions of the pad, thereby improving the convenience in manipulation of the pad and therefore greatly reducing driver fatigue during manipulation of the pad, and obtaining a more stable pivot motion of the pad. Further, a gap between the pedal housing and the lower end of the pad is removed, thereby preventing foreign substance and a driver's shoes from being caught in the gap. Furthermore, the pad is prevented from being lifted, thereby preventing injury to a driver's ankle caused from the lifting of the pad.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalent.

What is claimed is:

1. An accelerator pedal apparatus comprising:

a pedal housing having:

a lower mount fixed to a panel of a vehicle body; and an upper mount fixed to the lower mount and to which a pedal arm is pivotally mounted;

a pad pivotally mounted to the pedal housing, wherein the pad is connected to the pedal arm via a carrier; and an articulated hinge fixedly coupled, at both ends thereof, between the pedal housing and the pad such that the articulated hinge is covered by the pedal housing and the pad and thus the articulated hinge is not exposed to the outside of the pedal housing and the pad, wherein a middle portion of the articulated hinge is formed with an arcuate section protruding towards the lower mount and is spaced with a first gap from a partially circular section formed at a lower end of the pad, and wherein the middle portion of the articulated hinge is configured to selectively move toward the partially circular section according to a pivotal rotation of the pad and wherein when the pad is pivoted towards the pedal housing, the middle portion of the articulated hinge moves towards and comes into contacts with the partially circular section to prevent an excessive deformation of the articulated hinge and lifting of the pad.

2. The accelerator pedal apparatus according to claim 1, wherein the lower end of the pad is mounted to the lower mount with a second gap, and the lower mount is integrally provided with a cover part protruding so as to cover the lower end of the pad to prevent foreign substances and a driver's shoes from being caught in the second gap between the lower mount and the lower end of the pad.

3. The accelerator pedal apparatus according to claim 2, wherein an inner surface of the cover part and an outer surface at the lower end of the pad are formed into a pair of mating curved surfaces for a smooth pivot motion of the pad with respect to the pedal housing.

4. The accelerator pedal apparatus according to claim 1, wherein an end of the articulated hinge is coupled to the pad to prevent an excessive deformation of the articulated hinge when the pad is pivoted towards the pedal housing, such that the end of the articulated hinge is positioned between the lower end of the pad and the carrier.

5. The accelerator pedal apparatus according to claim 1, wherein the articulated hinge has more elasticity than the pad.

* * * * *